United States Patent [19]

Ohmura et al.

[11] Patent Number: 4,500,632

[45] Date of Patent: Feb. 19, 1985

[54] PROCESS FOR STABILIZING SILVER IMAGES

[75] Inventors: Kunioki Ohmura, Tokyo; Masaaki Torigoe, Kanagawa; Isamu Itoh, Kanagawa; Katsumi Hayashi, Kanagawa, all of Japan

[73] Assignee: Fuji Photo Film Co., Ltd., Kanagawa, Japan

[21] Appl. No.: 584,301

[22] Filed: Mar. 5, 1984

Related U.S. Application Data

[63] Continuation of Ser. No. 416,521, Sep. 9, 1982, abandoned.

[30] Foreign Application Priority Data

Sep. 9, 1981 [JP] Japan ..... 56-142022

[51] Int. Cl.[3] ..... G03C 5/24; G03C 5/38

[52] U.S. Cl. ..... 430/428; 430/429; 430/455; 430/352

[58] Field of Search ..... 430/427, 428, 429, 432, 430/453, 454, 455, 463, 352

[56] References Cited

U.S. PATENT DOCUMENTS

| | | | |
|---|---|---|---|
| 3,220,839 | 11/1965 | Herz et al. | 430/428 |
| 3,565,621 | 2/1971 | Tsuchida et al. | 430/429 |
| 3,617,283 | 11/1971 | Ohi et al. | 430/427 |
| 3,627,531 | 12/1971 | Nishio et al. | 430/455 |
| 4,230,792 | 10/1980 | Tsubai et al. | 430/427 |
| 4,322,493 | 3/1982 | Shibaoka et al. | 430/454 |

FOREIGN PATENT DOCUMENTS

| | | | |
|---|---|---|---|
| 2019024 | 10/1979 | United Kingdom | 430/429 |

OTHER PUBLICATIONS

Research Disclosure, Sep. 1972, #10141, pp. 62–63.

*Primary Examiner*—Mary F. Downey

*Attorney, Agent, or Firm*—Sughrue, Mion, Zinn, Macpeak, and Seas

[57] ABSTRACT

A process for stabilizing a silver image is disclosed. The process is utilized in connection with a photographic material which is comprised of a water impermeable support having one or more light-sensitive silver halide emulsion layers thereon. After the photographic material is exposed and developed it is subjected to further processing by conventional means. However, within the further processing an aqueous solution is utilized which includes any compounds represented by the general formula (I), (II) or (III) as defined within the specification. The compound(s) represented by the general formula is/are generally present within the processing solution in a total amount of about 0.1 to 10 g/l of processing solution. By utilizing the aqueous solution containing the compound represented by the general formula within the processing, it is possible to greatly increase the stability of the silver image formed.

6 Claims, No Drawings

PROCESS FOR STABILIZING SILVER IMAGES

This application is a continuation of application Ser. No. 416,521, filed Sept. 9, 1982, now abandoned.

FIELD OF THE INVENTION

The present invention relates to the stabilization of silver images and, particularly, to a process for preventing deterioration of silver images formed on a water impermeable support with the passage of time.

BACKGROUND OF THE INVENTION

In the field of silver halide photographic light-sensitive materials, silver images are suitable for recording information which must be stored over a long period, because the silver images are faster than the so-called color images (dye images). However, the silver images tend to deteriorate with the passage of time, and it has been found that the tendency is great when using a water impermeable support such as a plastic film, etc. Water impermeable supports such as plastic films, etc., are suitable for long period storage because they generally have higher strength than supports such as paper or cloth. However, they are not desirable because they result in increasing the deterioration of silver images as described above. Deterioration of silver images on the water impermeable supports has been reported in *Photographic Science and Engineering,* Vol. 7, pages 253–261 (1963) and *Journal of Applied Photographic Engineering,* Vol. 7 (No. 1), pages 1–9 (1981), etc.

An example of a technique for preventing deterioration of silver images on water impermeable supports involves a process which is carried out with compounds described in British Patent (publication) No. 2,019,024A. However, this is not sufficient to prevent deterioration of silver images in a severe oxidative gas or an oily paint atmosphere.

SUMMARY OF THE INVENTION

An object of the present invention is to prevent deterioration of silver images with the passage of time which is caused when using water impermeable supports.

The object of the present invention has been attained by providing a process for stabilizing silver images formed on a photographic light-sensitive material having at least one light-sensitive silver halide emulsion layer on a water impermeable support by exposure and development processing. The process is characterized by processing the silver images with an aqueous solution containing a compound represented by the following general formula (I), (II) or (III):

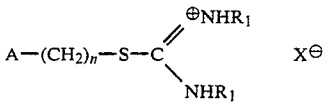

(I)

wherein:

A is —OH, —$SO_3^{\ominus}$ or

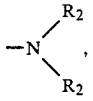

$R_1$ is H, an alkyl group having 1 to 5 carbon atoms, a substituted alkyl group or a phenyl group, $R_2$ is an alkyl group having 1 to 5 carbon atoms or a substituted alkyl group, $X^{\ominus}$ is a halogen atom or a p-toluenesulfonate, n is an integer of 2 to 5, however, general formula (I) includes an HX salt when A is

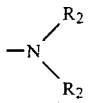

(wherein X has the same meaning as $X^{\ominus}$ described above);

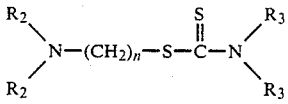

(II)

or an HX salt thereof wherein:

$R_3$ is H, an alkyl group having 1 to 5 carbon atoms, a substituted alkyl group or a phenyl group, n, $R_2$ and X have the same meaning as in general formula (I); or

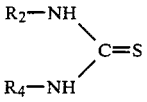

(III)

wherein:

$R_4$ is

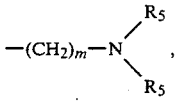

$R_5$ is H, or an alkyl group having 1 to 3 carbon atoms, m is 2 or 3, $R_2$ has the same meaning as in general formula (I), however, $R_2$ and $R_4$ may form a ring with —$CH_2$—$CH_2$— or —CH=CH—.

DETAILED DESCRIPTION OF THE INVENTION

Preferred examples of substituents for the substituted alkyl group represented by $R_1$ of general formula (I) involve —OH, —COOH, —$OCH_3$, —$OC_2H_5$, —$SO_3H$, an amino group, an alkylamino group and a phenyl group.

Preferred examples of substituents for the substituted alkyl group represented by $R_2$ of general formulae (I), (II) and (III) involve —$OCH_3$, —$OC_2H_5$, —$SO_3H$, an amino group, an alkylamino group, and a phenyl group.

Preferred examples of substituents for the substituted alkyl group represented by $R_3$ of general formula (II) involve —$OCH_3$, —$OC_2H_5$, —$SO_3H$, an amino group, an alkylamino group, and a phenyl group.

The compounds represented by the general formula (I), (II) or (III) can be synthesized as follows. Though the compounds of the present invention involve some novel compounds, the novel compounds can also be synthesized by the manners similar to the known compounds.

The compounds represented by the general formula (I) can be synthesized by applying the synthetic methods of the isothioureas to

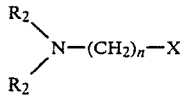

(wherein $R_2$ and n have the same meaning as in general formula (I), and X represents a halogen atom). The synthetic methods of the isothioureas are described in R. B. Wagner and H. D. Zook, *Synthetic Organic Chemistry,* page 779, John Wiley & Sons, Inc. (1953) and S. R. Sandler and W. Karo, *Organic Functional Group Preparations,* Vol. 2, pages 167, 168, 179 and 180, Academic Press (1971). The compounds represented by the general formula (I) can be also synthesized according to the manner as described in *Research Disclosure,* RD-15704 (May, 1977) wherein the compounds of the present invention are described as a persulfate bleach accelerating agent.

The compounds represented by the general formula (II) can be synthesized according to the manner as described in Japanese Patent Application (OPI) No. 26506/80 (the term "OPI" as used herein refers to a "published unexamined Japanese patent application") wherein the compounds of the present invention are described as a persulfate bleach accelerating agent.

The compounds represented by the general formula (III) can be synthesized by adding diamines to aminoalkylisocyanates according to the manner as described in S. R. Sandler and W. Karo, *Organic Functional Group Preparations,* Vol. 2, pages 135, 142, 216 and 217, Academic Press (1971).

The process of the present invention can be attained by adding the above described compound in any step after the development step. For example, the compound described above may be added to a stopping bath, a fixing bath, a water wash promoting bath, a rinsing bath or a rinsing bath after drying. It is particularly preferred to add it to a rinsing bath.

The compound of the present invention may be used as a mixture of two or more compounds.

The compound(s) is/are preferably added in a total amount of 0.1 to 10 g per liter of the processing solution, and is/are particularly preferably added in a total amount of 0.5 to 5 g per liter. The added amount of the compounds of the present invention is not influenced depending upon a kind of the compounds (i.e., the compounds represented by each general formula (I), (II) or (III)).

The compounds encompassed by the above formulae are particularly effective when used in connection with printing paper having a water impermeable support or photographic materials in which image preservation is required, such as microfilms.

Preferred examples of the compounds represented by the general formulae (I), (II) and (III) of the present invention are described below.

EXAMPLES OF COMPOUNDS (I-a) 2-Dimethylaminoethyl-isothiourea dihydrochloride
(I-b) 2-Diethylaminoethyl-isothiourea dihydrochloride
(I-c) 3-Dimethylaminopropyl-isothiourea dihydrochloride
(I-d) 2-Hydroxyethyl-isothiourea hydrochloride
(I-e) 2-Sulfoethyl-isothiourea hydrochloride
(I-f) 2-Dimethylaminoethyl-N-methyl-isothiourea dihydrochloride
(I-g) 2-Dimethylaminoethyl-N,N'-dimethyl-isothiourea dihydrochloride
(I-h) 3-Dimethylaminopropyl-N,N'-diphenyl-isothiourea dihydrochloride
(I-i) 2-Hydroxyethyl-N,N'-dibutyl-isothiourea hydrochloride
(I-j) 2-Sulfoethyl-N-alkyl-isothiourea hydrochloride
(II-a) S-(2-Dimethylaminoethyl)-N-methyldithiocarbamate hydrochloride
(II-b) S-(3-Dimethylaminopropyl)-N-ethyldithiocarbamate hydrochloride
(II-c) S-(2-Dipropylaminoethyl)-N-phenyldithiocarbamate p-toluenesulfonic acid
(II-d) S-(2-Diethylaminoethyl)-N,N'-dimethyldithiocarbamate hydrochloride
(II-e) S-(2-Dimethylaminoethyl)-N,N'-diethyldithiocarbamate hydrochloride
(III-a) N-(2-Dimethylaminoethyl)thiourea
(III-b) N-(3-Dimethylaminopropyl)-N'-dimethylthiourea
(III-c) N-(2-Diethylaminoethyl)thiourea
(III-d) N-(2-Dimethylaminoethyl)-N'-methylthiourea
(III-e) N-(2-Dipropylaminoethyl)-N'-phenylthiourea
(III-f) N-(2-Aminoethyl)-N'-butylthiourea
(III-g) N-(3-Aminopropyl)-N'-methylthiourea
(III-h) N-(2-Dimethylaminoethyl)-N'-phenylthiourea
(III-i) Imidazolidin-2-thione
(III-j) Imidazolin-2-thione Particularly preferred examples of the compounds of the present invention involve (I-a), (I-d), (I-e), (III-b) and (III-i).

Any stopping solution having a conventional composition can be used. Examples of stopping agents include acetic acids, sulfuric acids and sulfurous acid salts (e.g., $K_2S_2O_5$).

Any fixing solution having a conventional composition can be used. Examples of fixing agents include not only thiosulfates (e.g., alkali metal salts or ammonium salts) and thiocyanides but also organic sulfur compounds, the effect of which as the fixing agents has been known, acids (e.g., acetic acid) or sulfites (e.g., $Na_2SO_3$). The fixing solution may contain potassium, alum or water soluble aluminum salts as a hardener.

Examples of useful water wash promoting baths include solutions containing sulfites as a water wash promoter. Examples of useful rinsing baths used after the water wash include aqueous solutions containing surface active agents such as polyethylene glycol as a water removing agent.

In this disclosure the term "water impermeable support" means a support into which water does not permeate or hardly permeate. Preferred examples of such supports include transparent plastic films such as films of cellulose triacetate or polyethylene terephthalate, etc., white plastic films prepared by applying a dispersion of a white pigment such as titanium white in a binder such as gelatin to the above described plastic films, and paper supports both sides of which are laminated with a hydrophobic polymer such as polyethylene, polypropylene, etc. Among these water impermeable supports, the effect of the present invention is remarkably shown when using white plastic films and paper supports the both sides of which are laminated with a hydrophobic polymer (namely, water-impermeable, substantially opaque supports used for reflection type photographic materials).

If necessary, the support used in the present invention may be subjected to surface activation treatment such as chemical treatment, electric discharge treatment or ultraviolet ray treatment. Alternatively, the supports may be coated with a subbing layer. Furthermore, the supports may be subjected to the surface activation treatment and then may be coated with the subbing layer.

Examples of silver halides used in the silver halide photographic light-sensitive materials of the present invention include silver chloride, silver chlorobromide, silver bromide, silver iodobromide and silver iodobromochloride. The average particle size of silver halide particles is not limited, but it is preferably not larger than 3μ.

Though silver halide emulsions which are not chemically sensitized, the so-called primitive emulsions, can be used, the silver halide emulsions are generally chemically sensitized. In order to carry out chemical sensitization, it is possible to use processes described in the above cited literature written by Glafkides or Zelikman et al. and *Die Grundlagen der Photographischen Prozesse mit Silberhalogeniden,* edited by H. Frieser (Akademische Verlagsgesellschaft, 1968).

In order to carry out development of the photographic materials of the present invention, it is possible to use any known development process for forming silver images [as described in, e.g., *Research Disclosure,* Vol. 176, pages 28 and 29, chapters XIX and XX, (December, 1978)]. The processing temperature is generally selected from a range of 18° C. to 50° C., but a temperature lower than 18° C. or higher than 50° C. may be used.

Any developing solution having a conventional composition can be used [as described in, e.g., *Research Disclosure,* Vol. 176, pages 28 and 29, chapters XIX and XX, (December, 1978)]. Preferred examples of the developing agents include dihydroxybenzenes (for example, hydroquinone), 3-pyrazolidones (for example, 1-phenyl-3-pyrazlidone), and aminophenols (for example, N-methyl-p-aminophenol), which can be used alone or as a combination thereof. Particularly preferred examples of the developing agents include a combination of hydroquinone and 1-phenyl-3-pyrazolidone and a combination of hydroquinone and an aminophenol.

The developing solution generally contains known preservatives, alkali agents, pH buffers, and anti-fogging agents, etc., and, if necessary, it may contain dissolution assistants, toning agents, development accelerators, surface agents, defoaming agents, water softeners, hardeners and viscosity increasing agents, etc. The photographic materials of the present invention are generally processed with a developing solution containing sulfurous acid ion in an amount of 0.15 mol/l or more as a preservative.

In the following, the present invention is illustrated in greater detail by examples. However, this invention is not limited to these examples.

EXAMPLE 1

A silver iodobromide emulsion (silver bromide: 99% by mol) was prepared by precipitation of grains by a double jet process, physical ageing by a conventional process, desalting and sulfur sensitization and gold sensitization. Sodium salt of 2,4-dichloro-6-hydroxy-1,3,5-triazine (hardener) and sodium dodecylbenzenesulfonate (coating assistant) were added to the emulsion. The resulting emulsion was applied to a cellulose triacetate support. The silver content of the sample produced was 20 mg/dm$^2$.

This sample was tested as follows to measure the deterioration of silver images with the passage of time. Results are shown in Table 1.

Measurement of deterioration of the silver images with passage of time:

The sample was exposed to light through a step wedge and developed with a developing solution (D-19) at 20° C. for 5 minutes, followed by carrying out stopping, fixing, water wash and drying under conditions described below. After the processed sample was allowed to stand in a transparent box at room temperature (which herein refers to "about 25° C.") and 80% RH for 24 hours, a beaker containing 20 ml of hydrogen peroxide solution (7%) was placed in the above described box. The sample was allowed to stand for 7 hours in a room while applying the light of a 20 W fluorescent lamp. (This testing method has been described in *Photographic Science and Engineering,* Vol. 7, pages 253–261 (1963).) After allowing the sample to stand, the degree of deterioration of silver images formed was observed and evaluated as 5 stages consisting of remarkably great deterioration (xx), great deterioration (x), small deterioration (Δ), very small deterioration (o) and no deterioration (oo).

Another processed sample was allowed to stand for 2 weeks facing a plate coated with a synthetic resin oily white paint at an interval of 5 cm. Thereafter, the degree of deterioration of the silver images was observed and evaluated as 5 stages in the manner described above.

| | | |
|---|---|---|
| Stopping Solution: | | |
| 2% Aqueous solution of acetic acid | | |
| Fixing Solution: | | |
| Ammonium thiosulfate | | 200 g |
| Sodium sulfite | | 15 g |
| Acetic acid (28%) | | 55 cc |
| Boric acid | | 7.5 g |
| Potassium alum | | 15 g |
| Water to make | | 1 l |
| Water Wash Promoter: | | |
| 0.3% Aqueous solution of sodium sulfite | | |
| Rinsing Solution: | | |
| 0.1% Aqueous solution of polyethylene glycol (MW 300) | | |
| Processing Step: | | |
| Development | 20° C. | 5 minutes |
| Stopping | Room temperature | 30 seconds |
| Fixation | " | 2 minutes |
| Water wash promoting bath | " | 2 minutes |
| Water wash | " | 10 minutes |
| Rinsing | " | 15 seconds |

TABLE 1

| | | | Stability of Silver Image | |
|---|---|---|---|---|
| No. | Note | Processing | Hydrogen Peroxide Method | Oily Paint Method |
| 1 | Control | No additive | xx | xx |
| 2 | Comparison | Thiourea in fixing solution 1 g/l | o | x |

TABLE 1-continued

| No. | Note | Processing | Stability of Silver Image: Hydrogen Peroxide Method | Stability of Silver Image: Oily Paint Method |
|---|---|---|---|---|
| 3 | This invention | Compound (I-d) in stopping solution 1 g/l | oo | oo |
| 4 | This invention | Compound (III-b) in fixing solution 2 g/l | oo | oo |
| 5 | This invention | Compound (I-a) in rinsing solution 0.5 g/l | oo | oo |
| 6 | This invention | Compound (III-i) in water wash promoting bath 3 g/l | oo | oo |

The data in Table 1 clearly shows the improved stability of silver images, particularly with respect to the oily paint testing method when using the present invention. The comparative example which uses thiourea in the fixing solution shows particularly bad results when tested by the oil paint method. The silver images prepared according to the present invention are stabilized as tested in accordance with both methods.

EXAMPLE 2

An acid process silver chlorobromide emulsion (silver bromide: 50% by mol) was prepared by precipitation of grains by a double jet process, physical ageing by a conventional method, desalting treatment and sulfur sensitization. Sodium salt of 2,4-dichloro-6-hydroxy-1,3,5-triazine (hardener) and sodium dodecylbenzenesulfonate (coating assistant) were added to the emulsion. The resulting coating solution was applied to a paper support both sides of which were laminated with polyethylene. The silver content of the sample produced was 16 mg/dm$^2$.

This sample was tested as follows to measure the deterioration of silver images with the passage of time. Results are shown in Table 2.

Measurement of deterioration of the silver images with passage of timd:

The sample was exposed to light through a step wedge and developed with a developing solution (D-72) at 25° C. for 30 seconds, followed by carrying out stopping, fixing, water wash and drying under the following conditions. The processed sample was allowed to stand for 20 minutes in a cabinet having a nitrogen dioxide atmosphere (3,000 ppm) as described in British Patent (Publication) No. 2,019,024A. Thereafter, the sample was allowed to stand for 2 days in the open air (under sunlight). Another processed sample (photographic material) was allowed to stand for 2 weeks facing a plate coated with a synthetic resin oily white paint at an interval of 5 cm. After allowing the sample to stand, the degree of deterioration of silver images formed was measured and evaluated in a manner similar to Example 1.

Stopping Solution:

2% Aqueous solution of acetic acid

Fixing Solution:

-continued

| | | |
|---|---|---|
| Sodium thiosulfate | | 360 g |
| Sodium sulfite | | 15 g |
| 25% Acetic acid | | 48 cc |
| Boric acid | | 7.5 g |
| Potassium alum | | 15 g |
| Water to make | | 1 l |
| Rinsing Solution: | | |
| 0.1% Aqueous solution of polyethylene glycol (MW) | | |
| Processing Step: | | |
| Development | 25° C. | 30 seconds |
| Stopping | Room temperature | 10 seconds |
| Fixation | " | 2 minutes |
| Water wash | " | 10 minutes |
| Rinsing | " | 15 seconds |

TABLE 2

| No. | Note | Processing | Stability of Silver Images: Nitrogen Dioxide Method | Stability of Silver Images: Oily Paint Method |
|---|---|---|---|---|
| 1 | Control | No additive | xx | xx |
| 2 | Comparison | Fixing solution + 2-mercapto-ethylamine 0.5 g/l | o | Δ |
| 3 | This invention | Fixing solution + Compound (I-a) 0.5 g/l | oo | oo |
| 4 | This invention | Rinsing solution + Compound (I-e) 3 g/l | oo | oo |

The above results clearly show that the use of compounds of the present invention greatly improves the stability of silver images. Although the above results relate only to a few specific compounds of the invention it is believed that all compounds encompassed by the general formulae (I), (II) or (III) have similar effects on increasing the stability of silver images.

While the invention has been described in detail and with reference to specific embodiments thereof, it will be apparent to one skilled in the art that various changes and modifications can be made therein without departing from the spirit and scope thereof.

What is claimed is:

1. A process for stabilizing a black-and white silver image comprising the steps of:

providing a photographic material comprised of a water impermeable support having a light-sensitive silver halide emulsion layer thereon;

exposing the material;

subjecting the exposed material to development processing to obtain a developed image; and processing the developed image with an aqueous solution containing a compound represented by the following general formula (I) or (II):

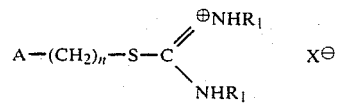

(I)

wherein:

A is —OH, —$SO_3^{\ominus}$ or

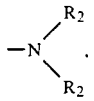

$R_1$ is H, an alkyl group having 1 to 5 carbon atoms, a substituted alkyl group or a phenyl group, $R_2$ is an alkyl group having 1 to 5 carbon atoms or a substituted alkyl group, $X^{\ominus}$ is a halogen atom or a p-toluenesulfonate, and n is an integer of 2 to 5, however, general formula (I) includes an HX salt when A is

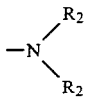

(wherein X are the same as $X^{\ominus}$ described above);

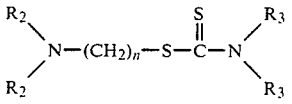

(II)

or an HX salt thereof wherein:

$R_3$ is H, an alkyl group having 1 to 5 carbon atoms, a substituted alkyl group or a phenyl group, and n, $R_2$ and X are the same as in the general formula (I).

2. A process for stabilizing a silver image as claimed in claim 1, wherein the processing of the developed image includes a rinsing bath which contains the compound represented by the general formula (I) or (II).

3. A process for stabilizing silver image as claimed in any of claims 1 or 2, wherein the compound represented by the general formula (I) or (II) is present in an amount of 0.1 to 10 g/l of processing solution.

4. A process for stabilizing a silver image as claimed in claim 3, wherein the compound represented by the general formula (I) or (II) is present in an amount of 0.5 to 5 g/l of processing solution.

5. A process for stabilizing a silver image as claimed in any of claims 1 or 2, wherein the water impermeable support is a paper support having both sides laminated with a hydrophobic polymer.

6. A process for stabilizing a silver image as claimed in any of claims 1 or 2, wherein the processing of the developed images is carried out at a temperature of between 18° C. to 50° C.

* * * * *